US008396233B2

(12) United States Patent
Ma et al.

(10) Patent No.: US 8,396,233 B2
(45) Date of Patent: Mar. 12, 2013

(54) BEAM FORMING IN SPATIALIZED AUDIO SOUND SYSTEMS USING DISTRIBUTED ARRAY FILTERS

(75) Inventors: Wei Ma, San Ramon, CA (US); Yunhong Li, Santa Clara, CA (US); Ahmad Bahai, Lafayette, CA (US)

(73) Assignee: Texas Instruments Incorporated, Dallas, TX (US)

( * ) Notice: Subject to any disclaimer, the term of this patent is extended or adjusted under 35 U.S.C. 154(b) by 236 days.

(21) Appl. No.: 12/874,502

(22) Filed: Sep. 2, 2010

(65) Prior Publication Data

US 2011/0051937 A1 Mar. 3, 2011

Related U.S. Application Data

(60) Provisional application No. 61/275,748, filed on Sep. 2, 2009.

(51) Int. Cl.
*H04R 5/02* (2006.01)

(52) U.S. Cl. ..... 381/303; 381/120; 381/96; 381/97

(58) Field of Classification Search ..... 381/303, 381/2, 120, 335, 336, 89, 92, 87, 386, 387, 381/96, 56, 97, 102, 104, 107
See application file for complete search history.

(56) References Cited

U.S. PATENT DOCUMENTS 4,775,995 A * 10/1988 Chapman et al. ..... 455/522
5,233,664 A * 8/1993 Yanagawa et al. ..... 381/89
5,953,432 A * 9/1999 Yanagawa et al. ..... 381/335
7,085,542 B2 8/2006 Dietrich et al.
7,515,719 B2 4/2009 Hooley et al.
7,577,260 B1 8/2009 Hooley et al.
2003/0095666 A1* 5/2003 Ramage ..... 381/2
2003/0109314 A1 6/2003 Ku
2005/0025326 A1 2/2005 Hussaini et al.
2005/0137730 A1* 6/2005 Trautmann et al. ..... 700/94
2007/0253575 A1 11/2007 Melanson
2007/0253583 A1 11/2007 Melanson
2008/0037813 A1 2/2008 Entner
2008/0101631 A1 5/2008 Jung et al.
2009/0161880 A1 6/2009 Hooley et al.
2009/0296954 A1 12/2009 Hooley et al.

(Continued)

FOREIGN PATENT DOCUMENTS

JP 2000167240 A 6/2000

OTHER PUBLICATIONS

"YSP-1100", Yamaha, Sep. 2, 2010, 3 pages.

(Continued)

*Primary Examiner* — Xu Mei
*Assistant Examiner* — Ammar Hamid
(74) *Attorney, Agent, or Firm* — John R. Pessetto; W. James Brady; Frederick J. Telecky, Jr.

(57) ABSTRACT

A system includes multiple speakers arranged in a speaker array configuration. The system also includes one or more filters configured to filter audio signals and generate filtered audio signals. The one or more filters are configured to operate using filter coefficients associated with a desired beam pattern to be produced by the multiple speakers. The system further includes at least one amplifier configured to amplify the filtered audio signals and provide the amplified filtered audio signals to the speakers. The one or more filters reside within or are coupled to the at least one amplifier. The system may further include a controller configured to modify at least one of the filter coefficients based on a change in the speaker configuration. The filters may operate independently of a centralized processor, and a centralized processor may not even be required to provide electronic beam forming.

9 Claims, 9 Drawing Sheets

U.S. PATENT DOCUMENTS

2011/0064254 A1* 3/2011 Li et al. ..... 381/334

OTHER PUBLICATIONS

"Multi-channel surround sound from a single component . . . ", www.yamaha.com/yec/ysp1/resources/ysp_bro_06.pdf, 2005, 7 pages.

"Multi-channel surround sound enjoyment from a single component . . . ", www.yamaha.com/yec/ysp1/resources/ysp1_brochure.pdf, (No date), 4 pages.

"Binaural Technology for Mobile Applications", by staff technical writer, J. Audio Eng. Soc., vol. 54, No. 10, Oct. 2006, p. 990-995.

Notification of Transmittal of the International Search Report and the Written Opinion of the International Searching Authority, or the Declaration dated May 30, 2011 in connection with International Patent Application No. PCT/US2010/048456.

Notification of Transmittal of the International Search Report and the Written Opinion of the International Searching Authority, or the Declaration dated Jun. 3, 2011 in connection with International Patent Application No. PCT/US2010/047658.

* cited by examiner

BEAM FORMING IN SPATIALIZED AUDIO SOUND SYSTEMS USING DISTRIBUTED ARRAY FILTERS

CROSS-REFERENCE TO RELATED APPLICATION AND PRIORITY CLAIM

This application claims priority under 35 U.S.C. §119(e) to U.S. Provisional Patent Application No. 61/275,748 filed on Sep. 2, 2009, which is hereby incorporated by reference.

TECHNICAL FIELD

This disclosure is generally directed to audio systems. More specifically, this disclosure is directed to systems and methods related to beam forming in spatialized audio sound systems using distributed array filters.

BACKGROUND

Audio spatialized sound systems are very popular in home entertainment systems, home computing systems, and other systems. For example, a conventional audio surround sound system includes multiple speakers positioned around a listener, such as speakers in front, to the sides, and behind the listener. A centralized digital signal processor (DSP) is typically used to generate audio signals for the speakers in order to provide desired spatial effects.

Another conventional audio surround sound system uses a "speaker bar" positioned only in front of a listener. A speaker bar typically represents an appropriately-sized elongated block that contains tens or even hundreds of speakers pointing in different directions. Desired spatial effects can be produced by bouncing sound from the speaker bar off walls beside or behind a listener. Once again, a centralized digital signal processor is typically used to generate audio signals for the speakers in the speaker bar in order to provide the desired spatial effects.

Beam forming technology has been used in various conventional audio spatialized sound systems. Beam forming refers to the ability to direct audio waves in a particular direction, rather than simply broadcasting the audio waves into free space. There are generally two types of beam forming techniques used today. Acoustic beam formers typically rely on the physical sizes and positions of the speakers to produce desired spatial effects. Electronic beam formers typically rely on signal processing that is performed by the centralized digital signal processors before audio signals are provided to the speakers. The processing performed by the centralized digital signal processors produces the desired spatial effects. The processed audio signals are then distributed from the centralized digital signal processors to the speakers.

BRIEF DESCRIPTION OF DRAWINGS

For a more complete understanding of this disclosure and its features, reference is now made to the following description, taken in conjunction with the accompanying drawings, in which.

DETAILED DESCRIPTION

FIGS. 1 through 17, discussed below, and the various embodiments used to describe the principles of the present invention in this patent document are by way of illustration only and should not be construed in any way to limit the scope of the invention. Those skilled in the art will understand that the principles of the invention may be implemented in any type of suitably arranged device or system.

In accordance with this disclosure, beam forming is implemented using array filters placed within or connected to audio amplifiers. Each audio amplifier can be coupled to one or more speakers, and the array filter(s) can filter audio signals appropriately to implement beam forming in order to produce desired spatial effects. In this way, beam forming functionality is distributed across the various array filters and audio amplifiers. As a result, a less powerful centralized digital signal processor (or even no centralized digital signal processor) may be needed in an audio system. Also, this may allow more flexibility in arranging speakers and speaker arrays. It may be particularly effective in limited spaces, such as in student dormitories or in laptop computers, game consoles, and portable media player docks.

Figure 1:
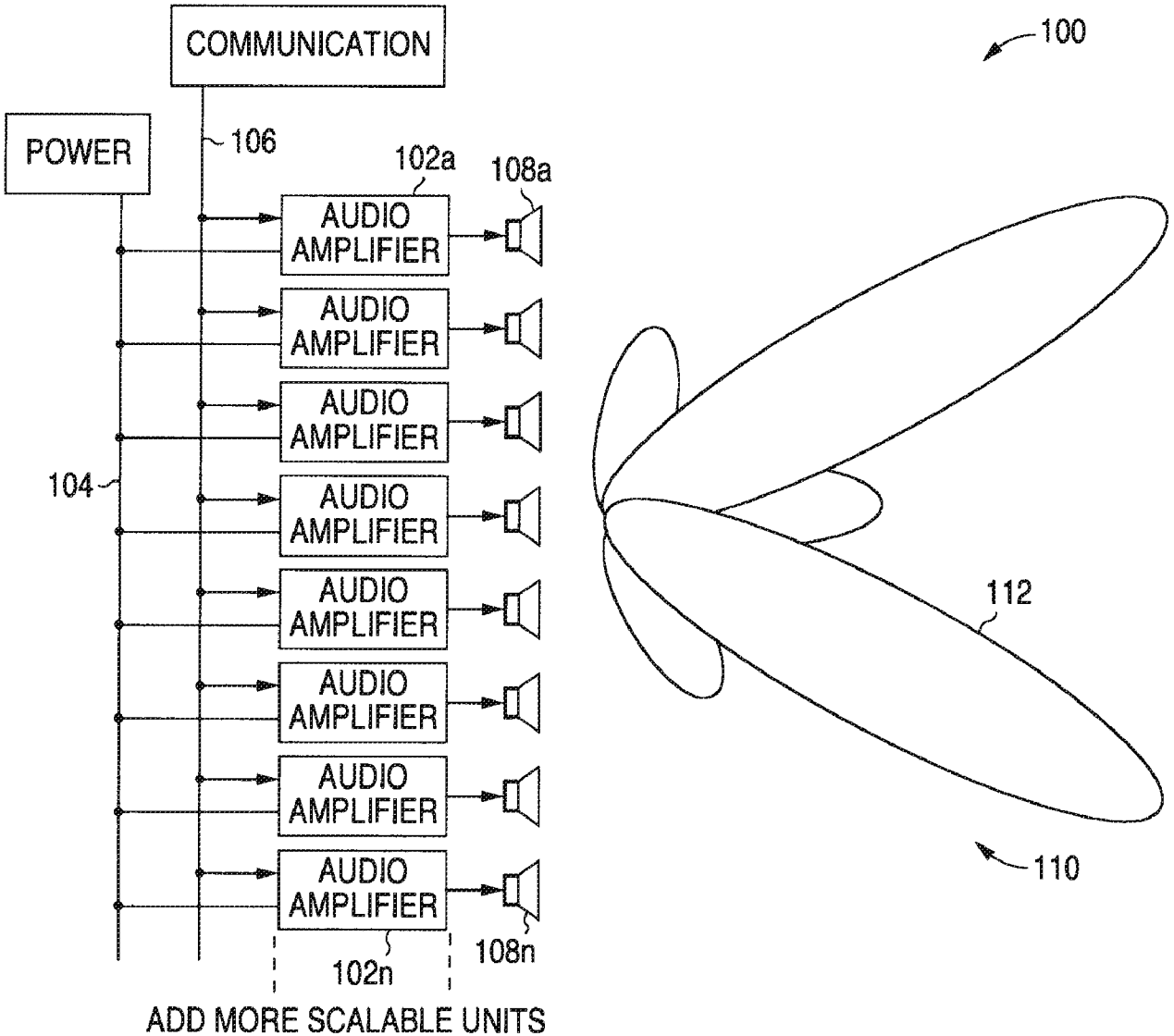
FIG. 1 illustrates an example audio system implementing distributed beam forming according to this disclosure.

FIG. 1 illustrates an example audio system 100 implementing distributed beam forming according to this disclosure. As shown in FIG. 1, the audio system 100 includes multiple audio amplifiers 102*a*-102*n*, each of which is coupled to a power line 104, a communication bus 106, and one or more speakers 108*a*-108*n*. The power line 104 provides operating power to each of the audio amplifiers 102*a*-102*n*. The communication bus 106 provides data (such as audio content data and control data) to each of the audio amplifiers 102*a*-102*n*. The communication bus 106 could represent any suitable type of bus, such as a SLIMBUS or $I^2S/I^2C$ bus. Each speaker 108*a*-108*n* could represent any suitable structure for generating sound, such as a moving coil speaker, ceramic speaker, piezoelectric speaker, subwoofer, or any other type of speaker. Note that each audio amplifier 102*a*-102*n* here could be coupled to any number of speakers.

In this example, the audio amplifiers 102*a*-102*n* implement distributed beam forming to direct sounds in particular directions. This means that the audio amplifiers 102*a*-102*n* can generate a sound field 110 in which different audio beams 112 are sent in specified directions to produce desired spatial effects. Details of the distributed beam forming performed by the audio amplifiers 102*a*-102*n* are provided below. Also, the audio system 100 shown in FIG. 1 is extendable, meaning that additional audio amplifiers can be easily added to the system 100 or existing audio amplifiers can be easily removed from the system 100 as needed or desired. Centralized digital signal processors that perform beam forming are typically not extendable, so it is not usually possible to simply add speakers to systems using those types of processors.

Figure 2:
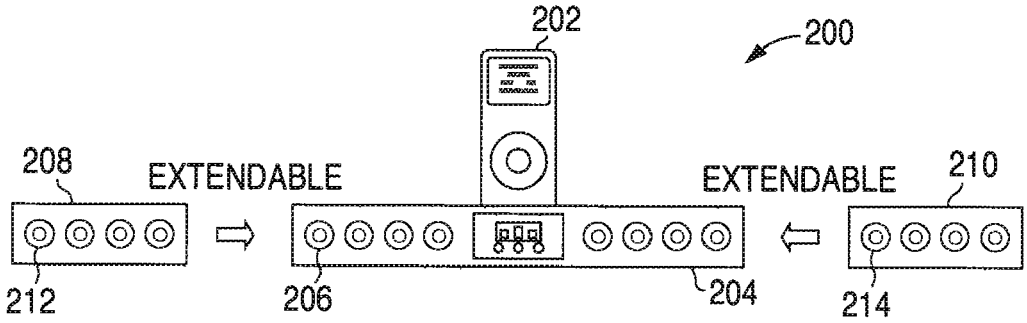
FIGS. 2 through 4 illustrate example speaker array configurations in an audio system according to this disclosure.
Figure 3:
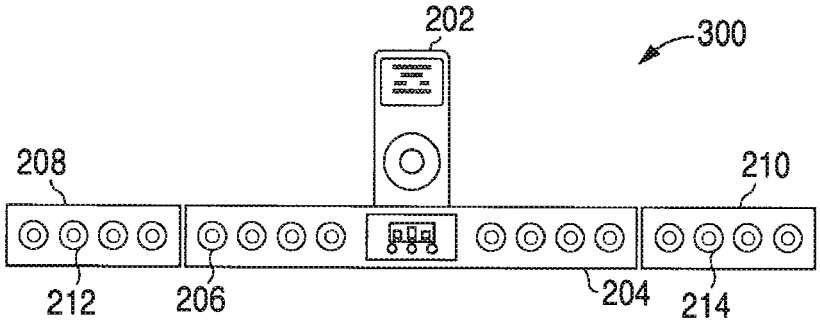
Figure 4:
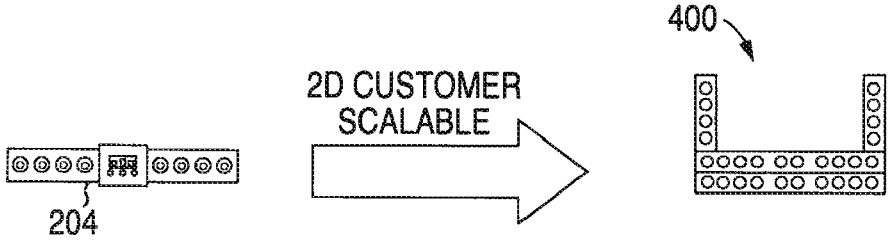

An audio system implementing a scalable speaker array can be used in any suitable type of arrangement. FIGS. 2 through 4 illustrate example speaker array configurations in an audio system according to this disclosure. As shown in FIG. 2, a speaker array configuration 200 is used in conjunction with a portable media player 202, which could represent any suitable media player (such as an APPLE IPOD or IPHONE). The portable media player 202 can be inserted into and removed from a dock 204. In this example, the dock 204 includes eight speakers 206. As shown in FIGS. 2 and 3, the dock 204 can be extended with additional sub-arrays 208-210, each of which includes four speakers 212-214, respectively. This creates a new speaker array configuration 300.

As a particular example, a portable device could include a smaller number of speakers (such as the eight-speaker dock 204). The portable device could be attached to additional speakers to create a larger speaker array with sharper beam focus. At a later time, the additional speakers could be removed so that the portable device could be moved once again. Note that any suitable number of speakers could be used in the portable device and that any suitable number of additional speakers could be used with the portable device.

Note that the configurations 200 and 300 shown in FIGS. 2 and 3 are one-dimensional, meaning the number of speakers is altered in one direction. However, multi-dimensional speaker array configurations could also be supported. As shown in FIG. 4, a multi-dimensional speaker array configuration 400 is implemented by extending the dock 204 with a number of sub-arrays arranged in multiple dimensions.

Any of these speaker array configurations 200-400, as well as other speaker array configurations, could be supported in the audio system 100 of FIG. 1 or other audio system. As described below, when speakers are added to or removed from a given audio system 100, the audio amplifiers 102*a*-102*n* can be updated (such as from a central controller or by the user) so that the remaining audio amplifiers can perform the appropriate beam forming operations.

Figure 5:
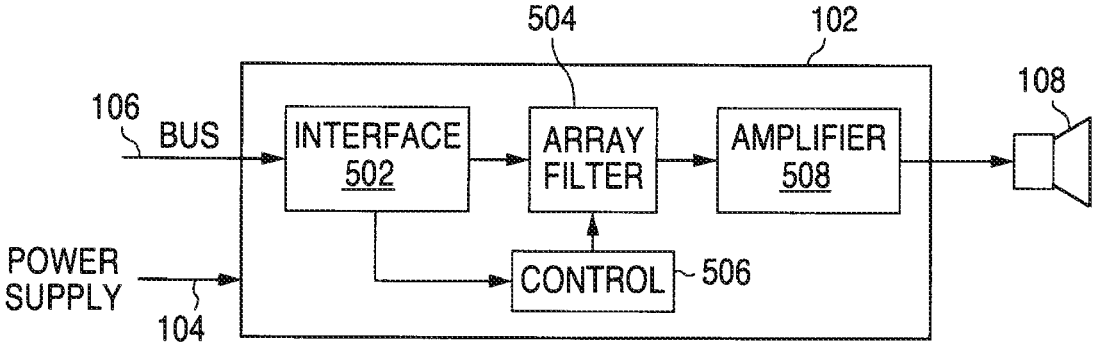
FIGS. 5 through 7 illustrate example audio amplifiers in an audio system implementing distributed beam forming according to this disclosure.
Figure 6:
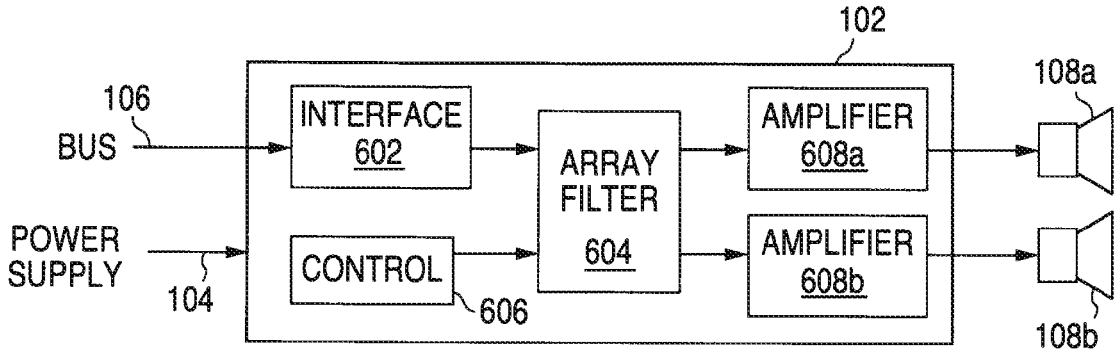
Figure 7:
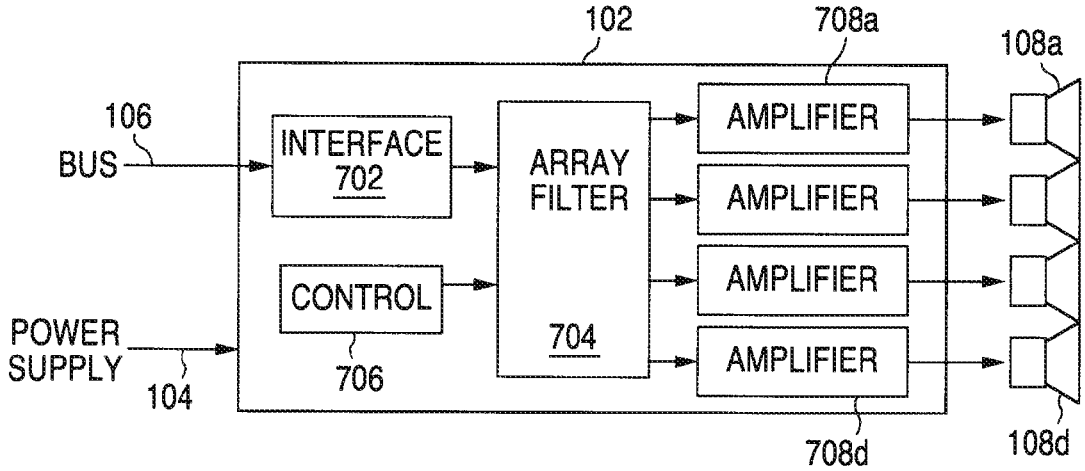

FIGS. 5 through 7 illustrate example audio amplifiers 102 in an audio system implementing distributed beam forming (such as the audio system 100) according to this disclosure. In particular, FIGS. 5 through 7 illustrate one-channel, two-channel, and four-channel audio amplifiers 102. Of course, any number of channels could be supported by a single audio amplifier 102.

As shown in FIG. 5, the one-channel audio amplifier 102 includes an interface 502 that receives data over a bus, such as the communication bus 106. The data could include audio content data and control data. The audio content data could include mono, stereo, or multi-channel (such as decoded 5.1 or 7.1) audio streams. The control data could include desired sound fields or beam patterns. The interface 502 includes any suitable structure for receiving data over a bus or other signal line, such as an interface to a SLIMBUS or $I^2S/I^2C$ bus. A SLIMBUS interface could receive audio content data and control data over the same bus. An $I^2S/I^2C$ interface could receive audio content data over a multi-drop $I^2S$ bus and control data over an $I^2C$ bus. Either type of interface 502 could support "plug and play" type functionality supporting the scalability of a speaker array.

The audio amplifier 102 also includes an array filter 504. The array filter 504 represents a filter that uses filter coefficients to provide desired beam forming patterns or other characteristics to audio content data. As described in more detail below, the filter coefficients can be updated dynamically in order to provide different beam forming functions. This can be useful, for instance, when the configuration of a speaker array changes, such as when speakers are added to or removed from the speaker array. The array filter 504 includes any suitable structure for filtering audio content data.

The audio amplifier 102 further includes a control unit 506 that controls the overall operation of the audio amplifier 102. The control unit 506 could, for example, receive control data identifying a desired sound field or beam pattern from the interface 502 and update the array filter 504 to provide the desired sound field or beam pattern. The control unit 506 includes any suitable structure for controlling the operation of an audio amplifier (including implementations permitting some aspects of user input or control, such as equalization or "EQ" control). In some embodiments, each audio amplifier has a unique identifier (such as a number) that could be used by an external system controller for use in reconfiguring a speaker array. In these embodiments, the control unit 506 in an audio amplifier 102 could use that audio amplifier's unique identifier to recognize control data intended for that audio amplifier 102 or to otherwise communicate with the external system controller or other component.

In addition, the audio amplifier 102 includes an amplifier 508, which amplifies the signals from the array filter 504 and provides the amplified signals to a speaker 108. The amplifier 508 could include any suitable structure for amplifying audio signals, such as a Class AB, B, D, G, or H amplifier of suitable output power for the speaker array configuration. For example, when implemented as a monolithic integrated circuit, the amplifier 508 could represent a low-power amplifier, such as a 0.5-2 W amplifier.

As shown in FIG. 6, the two-channel audio amplifier 102 includes an interface 602, array filter 604, and control unit 606. These components 602-606 may be the same as or similar to the corresponding components in FIG. 5. However, the array filter 604 as a micro beam former here outputs signals for two amplifiers 608*a*-608*b*, which are coupled to two speakers 108*a*-108*b*. Similarly, as shown in FIG. 7, the four-channel audio amplifier 102 includes an interface 702, array filter 704, and control unit 706. The array filter 704, as a four-channel micro beam former, here outputs signals for four amplifiers 708*a*-708*d*, which are coupled to four speakers 108*a*-108*d*.

In general, an array filter 504, 604, 704 can be used to filter audio content data for one or multiple speakers. Also, an array filter 504, 604, 704 could perform different functions depending on the speaker(s) attached to the audio amplifier. For instance, the array filter could implement modified signal delays and amplitudes to support a desired beam pattern for conventional speakers, or the array filter could implement modified cut-off frequencies and volumes for subwoofer applications. In general, an array filter could change an audio signal's phase, amplitude, or other characteristic(s) to generate complex beam patterns. For multi-channel audio signals (such as stereo, 5.1, or 7.1 format), an array filter can modify each audio signal stream individually, combine them, and send the combined streams to a speaker. In particular embodiments, each array filter includes calibration and offset compensation circuits for speaker mismatch in phase and amplitude and circuit mismatch in phase and amplitude.

Figure 8A:
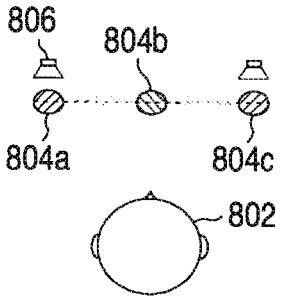
FIGS. 8A and 8B illustrate example listener perceptions with and without beam forming according to this disclosure.
Figure 8B:
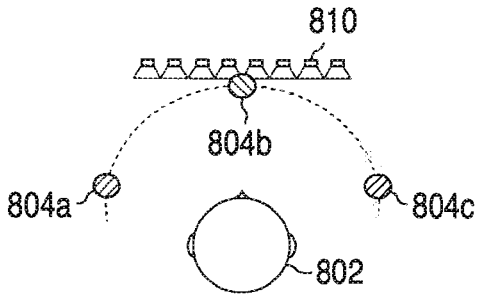

The beam forming provided by the audio amplifiers 102*a*-102*n* in the audio system 100 of FIG. 1 can make it appear that sound is coming from one or more desired directions. FIGS. 8A and 8B illustrate example listener perceptions with and without beam forming according to this disclosure. FIG. 8A illustrates a conventional stereo system where, from the perspective of a listener 802, sound events 804*a*-804*c* appear to come directly from two speakers 806 in front of the listener 802. In other words, from the listener's perspective, the sounds appear to originate at or between the two speakers 806. This is typically undesirable in higher-end consumer electronics since the listener 802 typically does not desire to perceive that all sounds are originating in front of the listener 802, especially since many sound media programs place sounds outside the frontal area (such as 5.1 or 7.1 audio surround systems).

FIG. 8B illustrates the effects of beam forming that could be implemented using the audio amplifiers 102*a*-102*n* in the audio system 100 of FIG. 1. Here, even though a speaker array 810 is directly in front of the listener 802, sound events 804*a*-804*c* appear to come from different directions. This allows the speaker array 810 to "position" a sound source in a more realistic location and increase the sound depth. As a result, the audio system 100 of FIG. 1 can implement a form of "virtual headphones" that provides better subjective sound quality.

Figure 9:
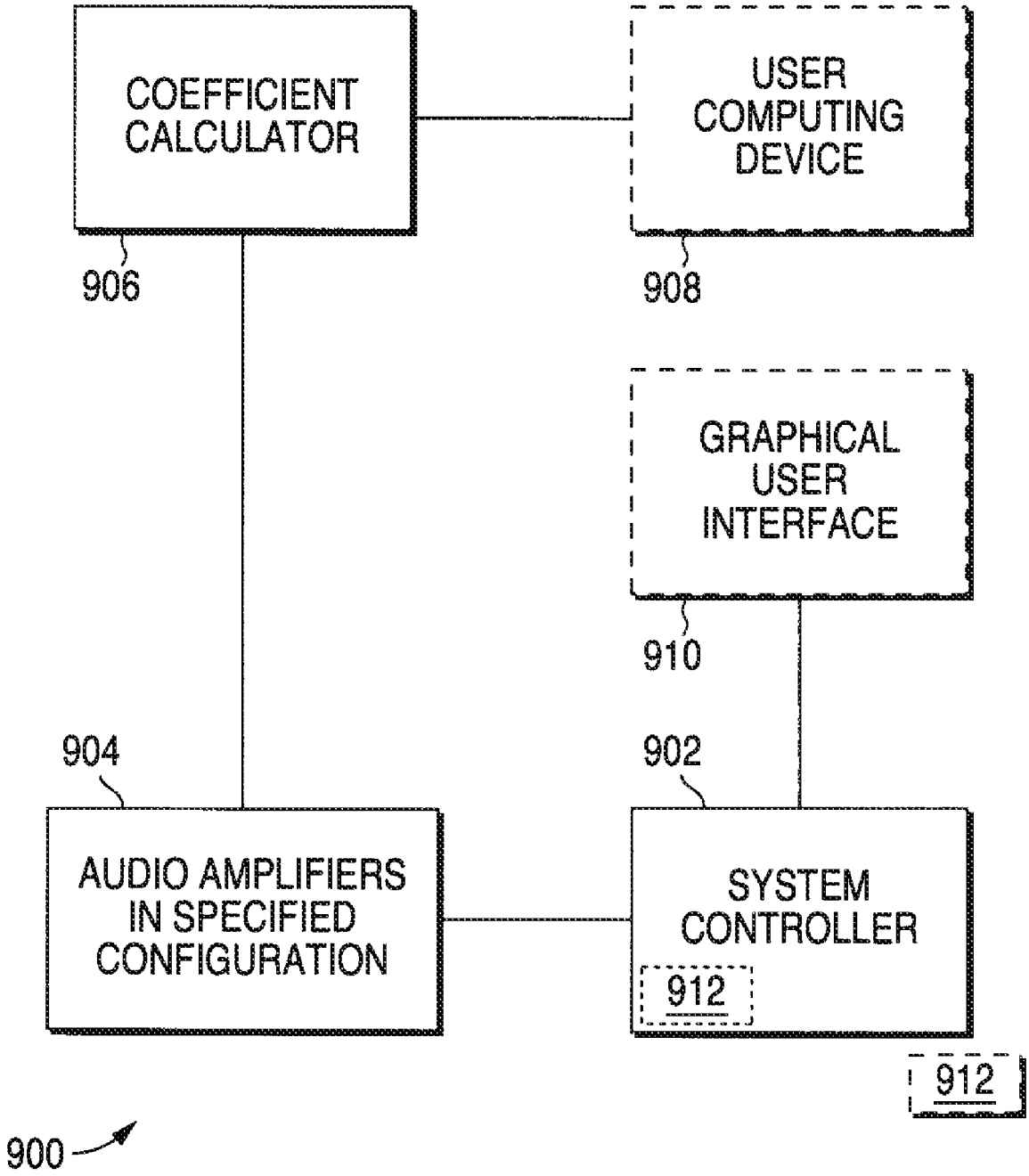
FIG. 9 illustrates an example system for providing filter coefficients to audio amplifiers in order to support distributed beam forming according to this disclosure.

As noted above, the filter coefficients used by the array filters 504, 604, 704 in FIGS. 5 through 7 may vary depending on the configuration of the speaker array. This is because a different configuration of speakers may require different filter coefficients to provide a desired beam pattern. FIG. 9 illustrates an example system 900 for providing filter coefficients to audio amplifiers in order to support distributed beam forming according to this disclosure. As shown in FIG. 9, a system controller 902 is coupled to one or more audio amplifiers 904 arranged in a specified configuration. The audio amplifiers 904 could represent any combination of the audio amplifiers described above (such as one-channel, two-channel, and/or four-channel amplifiers). The system controller 902 can receive filter coefficients for one or more array filters 504, 604, 704 in the audio amplifiers 904 and provide the filter coefficients to the audio amplifiers 904. The audio amplifiers 904 can then update the array filters 504, 604, 704 with the provided filter coefficients.

The system 900 in FIG. 9 includes a coefficient calculator 906, which retrieves (from any suitable memory device), determines, or otherwise identifies the filter coefficients for a given speaker array configuration. The coefficient calculator 906 can receive data identifying the speaker array configuration, and the coefficient calculator 906 can use one or more algorithms to determine the appropriate filter coefficients that can achieve one or more specified spatial effects. The coefficient calculator 906 could use any other data to identify the filter coefficients, such as the type(s) of speakers used with the speaker array configuration. The coefficient calculator 906 can then output the identified filter coefficients. The coefficient calculator 906 could represent any suitable structure for identifying filter coefficients, such as an application executed on a user's computing device 908 or on a remote platform (like a server providing a web service accessible over the Internet by a browser).

The coefficient calculator 906 can use any suitable technique to calculate the filter coefficients. For example, the coefficient calculator 906 could take into account the acoustic housing design of the speakers in the speaker array, the placement/configuration of the speakers, and source position requirements. Also, as noted above, the filter coefficients can be designed to focus sound to two positions (at or near the ears of a listener), which can include beam pattern control and cross-talk cancellation.

In some embodiments, the system controller 902 could provide the coefficient calculator 906 with the speaker array configuration. This could be done, for example, based on information obtained from the audio amplifiers 904 in the speaker array. In these embodiments, the system controller 902 could receive the filter coefficients from the coefficient calculator 906 and provide the filter coefficients to the audio amplifiers 904. This could be done automatically or in response to user input.

In other embodiments, a user can access the coefficient calculator 906, such as by executing the coefficient calculator on the user's computing device 908 or by accessing the coefficient calculator over a network. The user's computing device 908 could represent a laptop computer, desktop computer, tablet computer, smartphone, or other mobile or fixed computing device. The user could use the computing device 908 to transmit data to the coefficient calculator 906 defining the speaker array configuration, and the coefficient calculator 906 could provide the identified filter coefficients back to the user's computing device 908 or directly to the system controller 902. If provided to the user's computing device 908, the user could use a graphical user interface 910 to interact with the system controller 902 and to provide the system controller 902 with the identified filter coefficients.

These embodiments represent specific, non-limiting examples of how filter coefficients could be provided to one or more audio amplifiers 904. Any other suitable techniques could be used to provide filter coefficients to one or more audio amplifiers 904. For example, the system controller 902 could include a memory 912 that stores filter coefficients for multiple speaker array configurations, and the filter coefficients for a given speaker array configuration could be retrieved from the memory 912 when needed. Note that the memory 912 storing filter coefficients for speaker array configurations need not reside within the system controller 902 and could reside at any location(s) accessible to the system controller 902 or other component of the audio system. Also note that a combination of approaches could be used, such as when the coefficient calculator 906 is accessed only if a local memory 912 lacks filter coefficients for a specified speaker array configuration.

Figure 10:
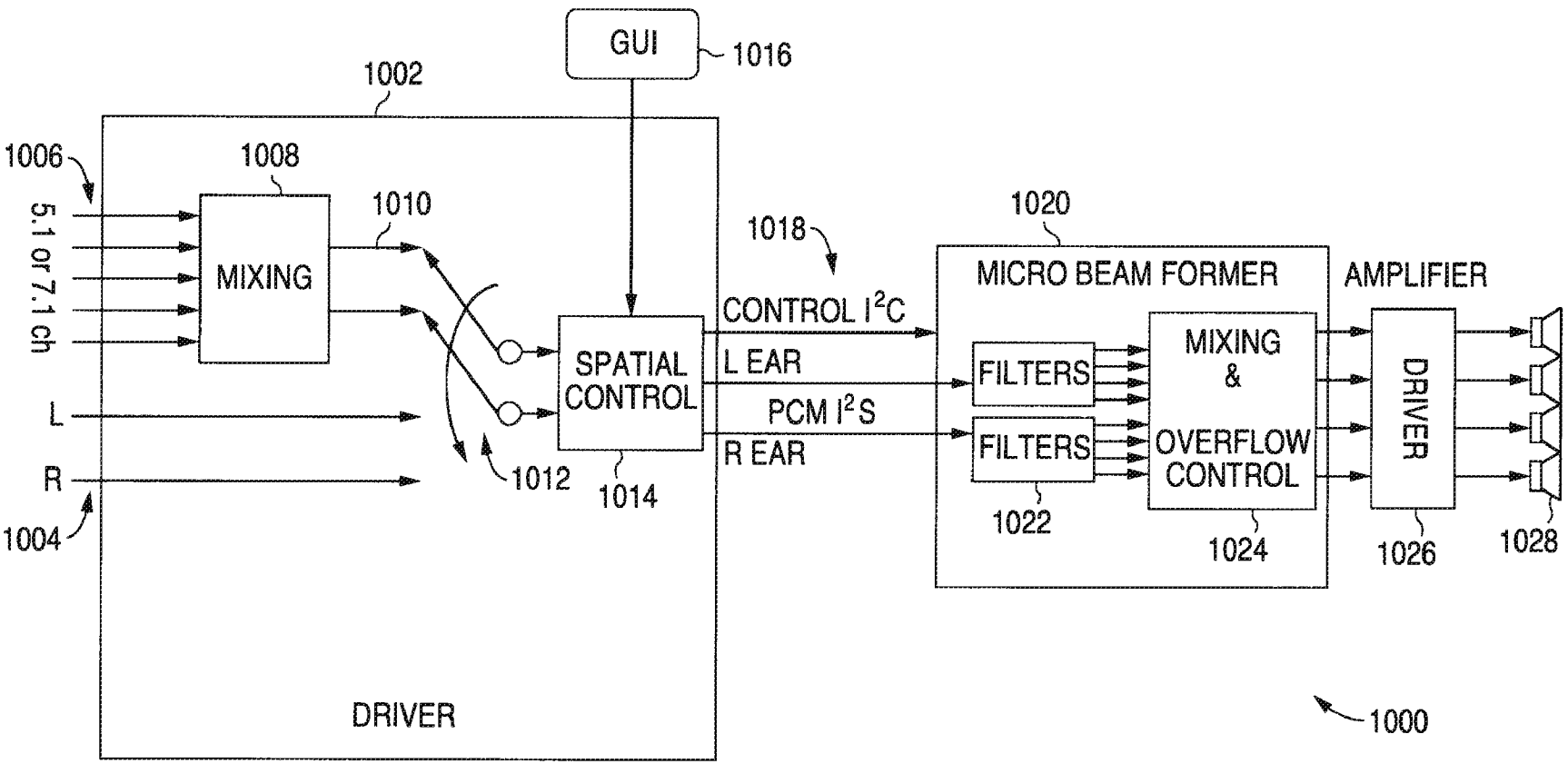
FIG. 10 illustrates another example audio system implementing distributed beam forming according to this disclosure.

FIG. 10 illustrates another example audio system 1000 implementing distributed beam forming according to this disclosure. In this example, a driver 1002 (such as one implemented in hardware, software, and/or firmware) can receive either left/right (L/R) stereo audio signals 1004 or multi-channel (5.1/7.1) audio signals 1006. The multi-channel audio signals 1006 can be mixed in a mixing unit 1008 to produce a pair of signals 1010. The stereo or mixed pair of signals 1004 or 1010 is provided via switches 1012 to a spatial control unit 1014, which is configured using a graphical user interface (GUI) 1016. The graphical user interface 1016 can be used to define a speaker array configuration, identify whether stereo or multi-channel data should be used, or perform other functions such as selecting or receiving filter coefficients as described above.

The spatial control unit 1014 outputs control data on an $I^2C$ bus and pulse code modulation (PCM) audio content data on an $I^2S$ bus, where the buses are collectively identified at 1018. This data is received by a micro beam former 1020, which implements array filters 1022 used for beam forming. The micro beam former 1020 also includes a mixing and overflow control unit 1024 that, among other things, performs additional mixing (such as to combine two streams into a single stream). The micro beam former 1020 includes any suitable structure for performing beam forming using one or more array filters, such as a CMOS9t5v 1.8V device.

The outputs of the micro beam former 1020 are provided to one or more audio amplifiers 1026 to drive one or multiple speakers 1028. Each audio amplifier 1026 could represent any suitable amplification device, such as a ±9V CMOS8 or ±5V CMOS9 Class D amplifier. The audio amplifier 1026 here could be used to drive four speakers 1028 (such as four ceramic speakers), although this is for illustration only. Note here that the array filters 1022 are implemented externally of the audio amplifier 1026, but again the filtering is performed more locally to the audio amplifier 1026 and not in a powerful centralized digital signal processor.

Figure 11:
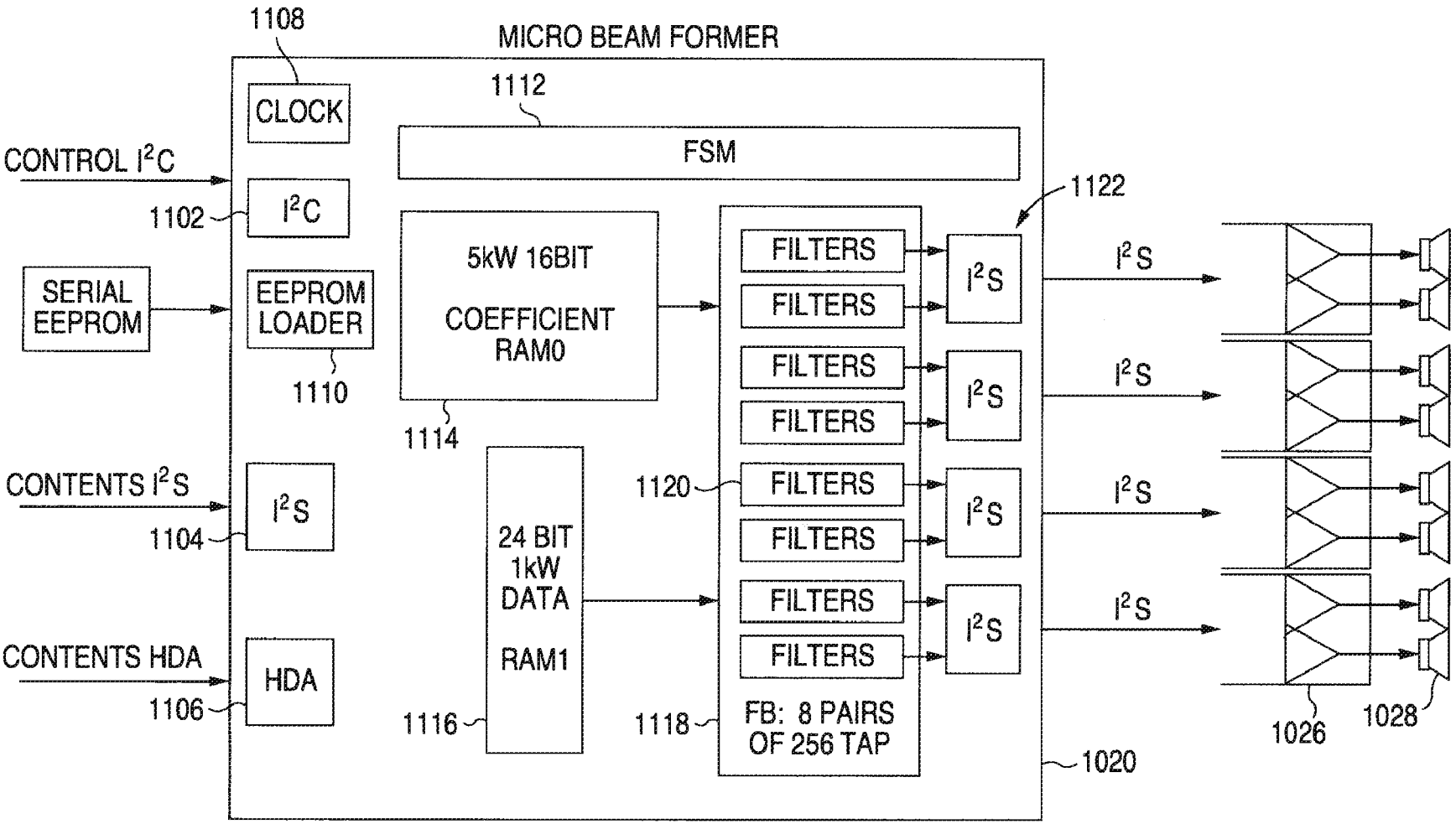
FIG. 11 illustrates an example of a micro beam former in an audio system according to this disclosure.

FIG. 11 illustrates an example micro beam former 1020 in the audio system 1000 according to this disclosure. In this example, the micro beam former 1020 includes an $I^2C$ interface 1102 for receiving control data over an $I^2C$ bus, an $I^2S$ interface 1104 for receiving audio data over an $I^2S$ bus, and a high definition audio (HDA) interface 1106 for receiving audio data over an HDA bus. Note that any other or additional interfaces could be used. The micro beam former 1020 also includes a clock 1108 for timing operations within the micro beam former 1020 and an EEPROM loader 1110 that can load data from an external serial EEPROM into the micro beam former 1020. The micro beam former 1020 further includes a finite state machine (FSM) 1112 for controlling the operations of the micro beam former 1020.

Filter coefficients are stored in a first random access memory (RAM0) 1114, which in this example represents a five kilo-word 16-bit memory (although other memories could be used). Audio content data received by the micro beam former 1020 is stored in a second random access memory (RAM1) 1116, which in this example represents a one kilo-word 24-bit memory (although other memories could be used). The audio content data is provided to a filter bank (FB) 1118, which in this example includes eight filters 1120. The filter bank 1118 uses the filter coefficients from the RAM 1114 to filter the audio content data from the RAM 1116. The filtered audio content data is provided to various $I^2S$ interfaces 1122, which provide the filtered audio content data to various amplifiers 1026 (such as four two-channel Class D or Class AB amplifiers). The amplifiers 1026 could be coupled to various speakers 1028, such as eight speakers or six speakers and two subwoofers.

Figure 12:
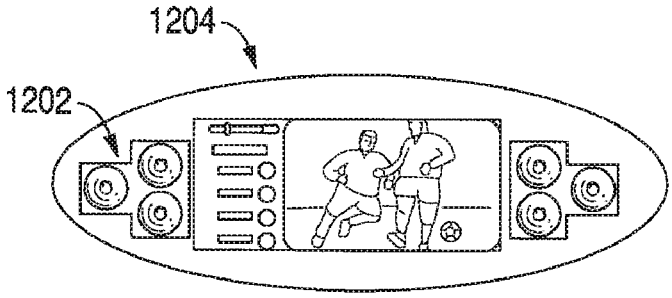
FIGS. 12 through 17 illustrate example consumer devices using an audio system implementing distributed beam forming according to this disclosure.
Figure 13:
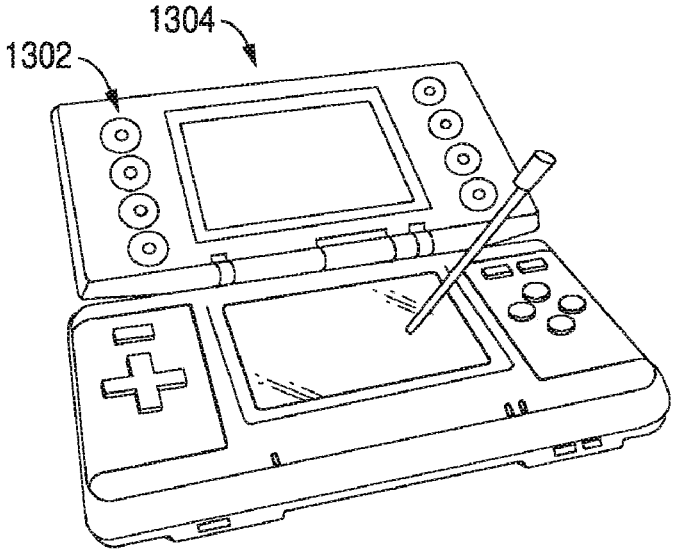
Figure 14:
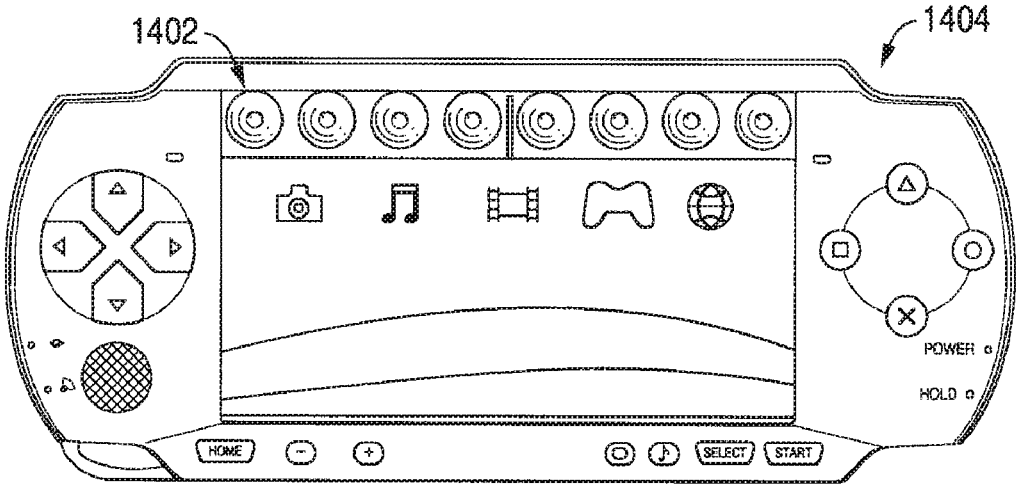
Figure 15:
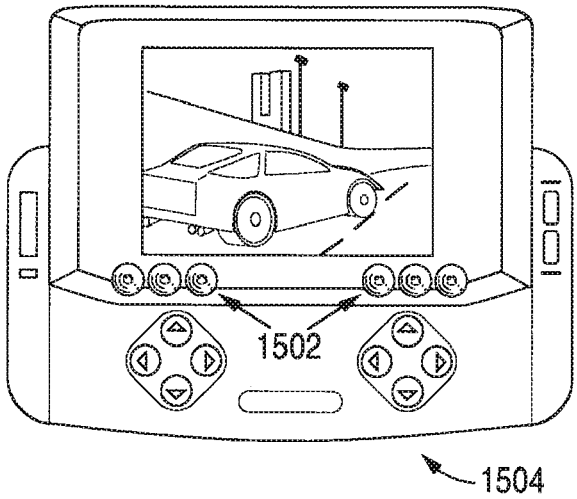

The audio systems 100 and 1000 described above could find use in a wide variety of settings. For example, FIGS. 12 through 17 illustrate example consumer devices using an audio system implementing distributed beam forming according to this disclosure. More specifically, FIG. 12 illustrates a six-speaker array 1202 (with associated audio amplifiers and other components) implemented in a video mobile telephone 1204. FIG. 13 illustrates an eight-speaker array 1302 implemented in a NINTENDO DS gaming system 1304. FIG. 14 illustrates an eight-speaker array 1402 implemented in a SONY PSP gaming system 1404. FIG. 15 illustrates a six-speaker array 1502 implemented in an MP4 media player 1504.

Figure 16:
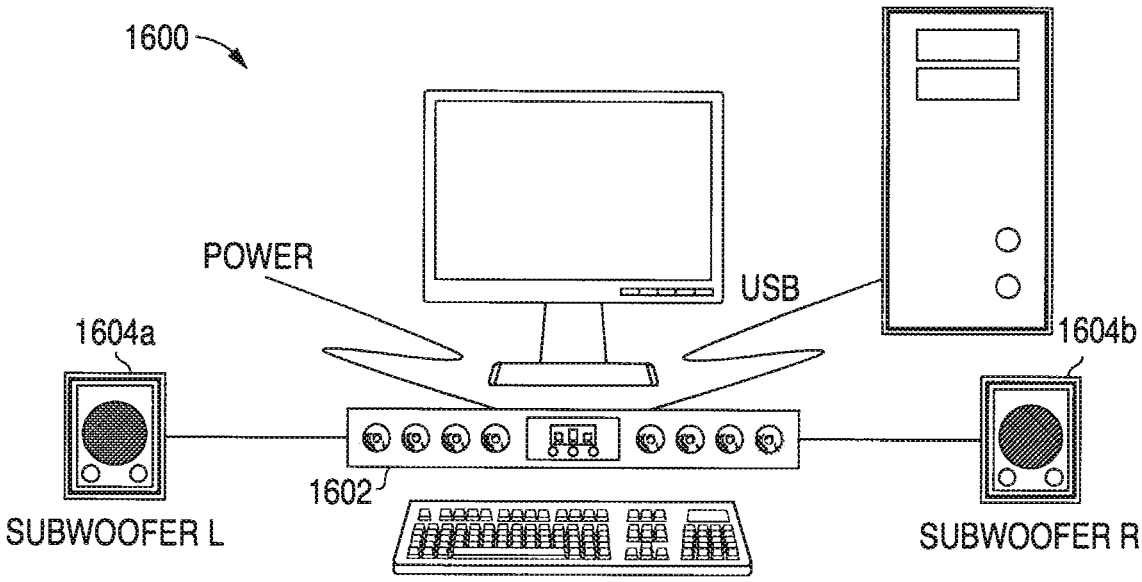
Figure 17:
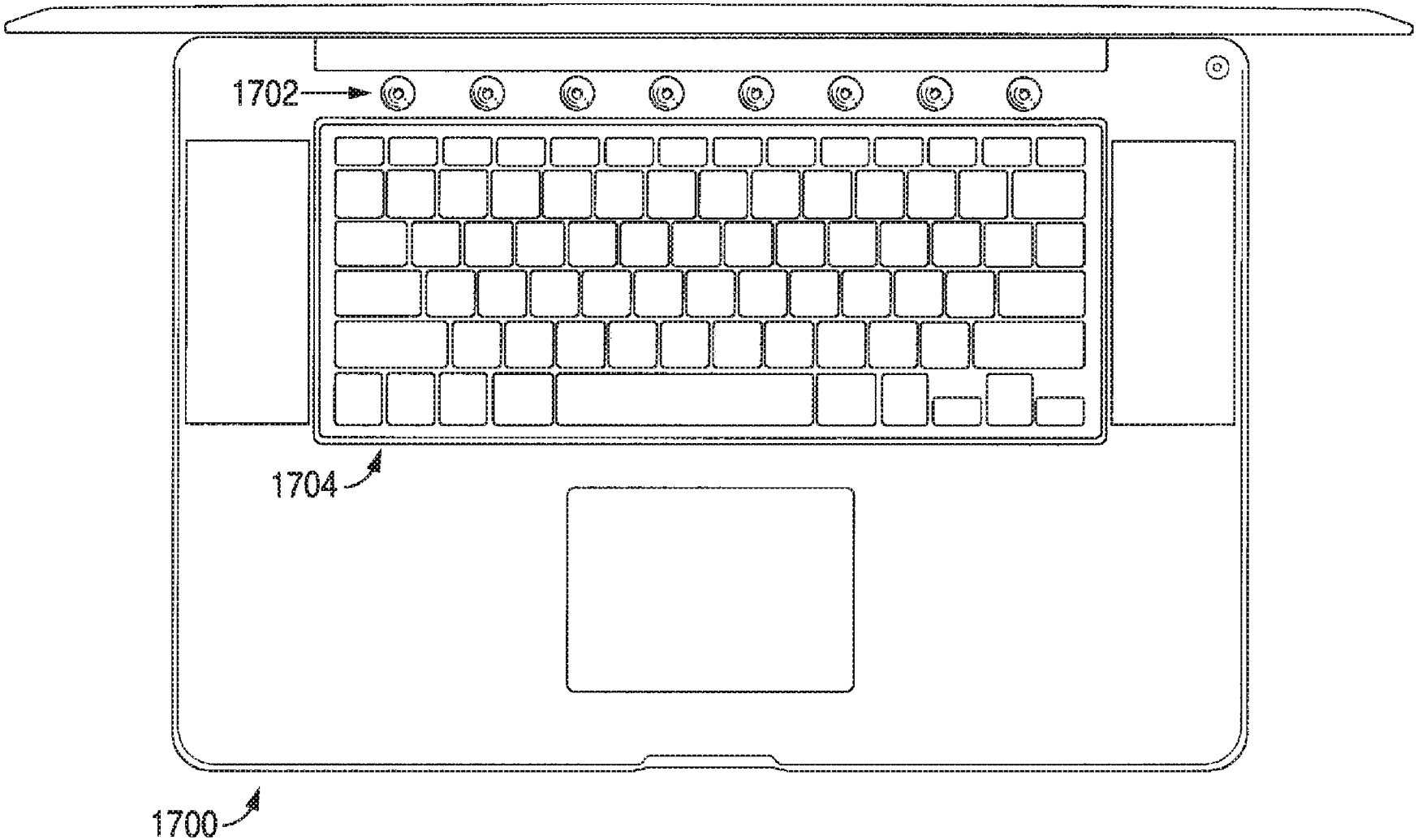

FIG. 16 illustrates a desktop computer system 1600 having an eight-speaker array 1602 and optional left and optional right subwoofers 1604*a*-1604*b*. Note that any suitable power supply (such 110V) and interface (USB 2.0) could be used. FIG. 17 illustrates a laptop computer 1700 (in this case, an APPLE MACBOOK—family laptop) having an eight-speaker array 1702 in the keyboard 1704 portion of the laptop. In FIGS. 16 and 17, beam forming techniques implemented by the audio amplifiers in the speaker arrays 1602 and 1702 can be used to make it appear to a listener that sounds are originating at the displays of the computer systems 1600 and 1700, rather than at areas below the displays. Note that the number and positions of the speakers in FIGS. 12 through 17 are for illustration only.

In general, the audio systems 100 and 1000 can be implemented in any suitable device or system, such as devices or systems intended for personal use or use in relatively small rooms. Specific examples include spatial positioning sound for gaming consoles, customer scalable sound projectors for spatialized sound systems, and flat-panel television speaker arrays. Additional functions that could be performed in particular implementations of the audio systems 100 and 1000 include room acoustic equalization, lip synchronization, and gain control. Another additional function could include modifying array filter coefficients to pre-compensate for speaker distortions, which may be useful when used with ceramic speakers or other speakers that suffer from known distortions.

While FIGS. 1 through 17 have illustrated various features of different types of audio systems, any number of changes may be made to these drawings. For example, while certain numbers of channels (such as one, two, four, or eight channels) may be shown in individual figures, any suitable number of channels can be used to transport any suitable type of data. Also, the components shown in the figures could be combined, omitted, or further subdivided and additional components could be added according to particular needs. Further, particular uses for the audio systems shown above are for illustration only. Any of these audio systems could be used in any suitable manner. In addition, features shown in one or more figures above may be used in other figures above.

In some embodiments, various functions described above are implemented or supported by a computer program that is formed from computer readable program code and that is embodied in a computer readable medium. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory.

It may be advantageous to set forth definitions of certain words and phrases that have been used within this patent document. The term "couple" and its derivatives refer to any direct or indirect communication between two or more components, whether or not those components are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like.

While this disclosure has described certain embodiments and generally associated methods, alterations and permutations of these embodiments and methods will be apparent to those skilled in the art. Accordingly, the above description of example embodiments does not define or constrain this invention. Other changes, substitutions, and alterations are also possible without departing from the spirit and scope of this invention as defined by the following claims.

What is claimed is:

1. A system comprising:

multiple speakers arranged in a speaker array configuration;

one or more filters configured to filter audio signals and generate filtered audio signals, the one or more filters configured to operate using filter coefficients associated with a desired beam pattern to be produced by the multiple speakers; and at least one amplifier configured to amplify the filtered audio signals and provide the amplified filtered audio signals to the speakers;

wherein the one or more filters reside within or are coupled to the at least one amplifier;

wherein the one or more filters are configured to perform calibration and offset compensation for both (i) speaker mismatch in phase and amplitude and (ii) circuit mismatch in phase and amplitude.

2. The system of claim 1, further comprising a controller configured to modify at least one of the filter coefficients based on a change in the speaker array configuration.

3. The system of claim 2, wherein the controller is configured to modify at least one of the filter coefficients based on input received from an external source.

4. The system of claim 1, wherein the speakers, the one or more filters, and the at least one amplifier form a portion of a portable media player, a portable gaming system, a portable computer, a desktop computer, a flat panel display, and a television.

5. An apparatus comprising:

an interface configured to receive audio content data;

a filter configured to filter the audio content data and generate filtered audio content data, the filter configured to operate using one or more filter coefficients associated with a desired beam pattern to be produced by at least one speaker; and an amplifier configured to amplify the filtered audio content data and provide the amplified filtered audio content data to the at least one speaker;

wherein the filter is configured to perform calibration and offset compensation for both (i) speaker mismatch in phase and amplitude and (ii) circuit mismatch in phase and amplitude.

6. The apparatus of claim 5, wherein:

the one or more filter coefficients are associated with a first speaker array configuration; and the filter is further configured to receive one or more second filter coefficients associated with a second speaker array configuration.

7. The apparatus of claim 5, wherein the interface comprises:

a first interface configured to receive the audio content data; and a second interface configured to receive control data associated with the desired beam pattern.

8. The apparatus of claim 5, wherein the interface comprises a single interface configured to receive the audio content data and control data associated with the desired beam pattern.

9. The apparatus of claim 5, wherein the amplifier comprises one of: a Class AB amplifier, a Class B amplifier, a Class D amplifier, a Class G amplifier, and a Class H amplifier.

* * * * *